US005410387A

United States Patent [19]

Yamada

[11] Patent Number: 5,410,387

[45] Date of Patent: Apr. 25, 1995

[54] DEVELOPING UNIT SUPPORTING SYSTEM

[75] Inventor: Hiroshi Yamada, Kato, Japan

[73] Assignee: Fujitsu Limited, Kawsaki, Japan

[21] Appl. No.: 110,618

[22] Filed: Aug. 20, 1993

[30] Foreign Application Priority Data

Feb. 23, 1993 [JP] Japan ..... 5-033626

[51] Int. Cl.[6] ..... G03G 15/00

[52] U.S. Cl. ..... 355/200; 355/245

[58] Field of Search ..... 355/200, 210, 245; 118/653

[56] References Cited

U.S. PATENT DOCUMENTS 3,689,146 9/1972 Ito et al. ..... 355/200 X 4,185,907 1/1980 Baier et al. ..... 355/200

FOREIGN PATENT DOCUMENTS 62-279353 12/1987 Japan .

1-92776 4/1989 Japan .

*Primary Examiner*—Joan H. Pendegrass

*Attorney, Agent, or Firm*—Nikaido, Marmelstein, Murray & Oram

[57] ABSTRACT

A developing unit supporting system designed for the purpose of minimizing space required for the removal of a developing unit to promote the miniaturization of an apparatus in which the system is incorporated and improving the efficiency when the developing unit is separated from the photosensitive drum. The system comprises: a carrier body which is supported on a fixed frame so as to move in a direction perpendicular to the axis of the photosensitive drum and is usually held at a developing unit set position by energizing device; and a slide table which can be moved in a direction perpendicular to the axis of the photosensitive drum to a mounting/dismounting position after it has moved relative to the carrier body in a direction substantially parallel with the axis of the photosensitive drum to a predetermined middle position. The fixed frame is provided with first movement operation device for operating the carrier body to move between the set position and a retraction position. The carrier body has second movement operation device for operating the slide table to move relative to the carrier body in a direction substantially parallel with the axis of the photosensitive drum.

22 Claims, 6 Drawing Sheets

FIG.3
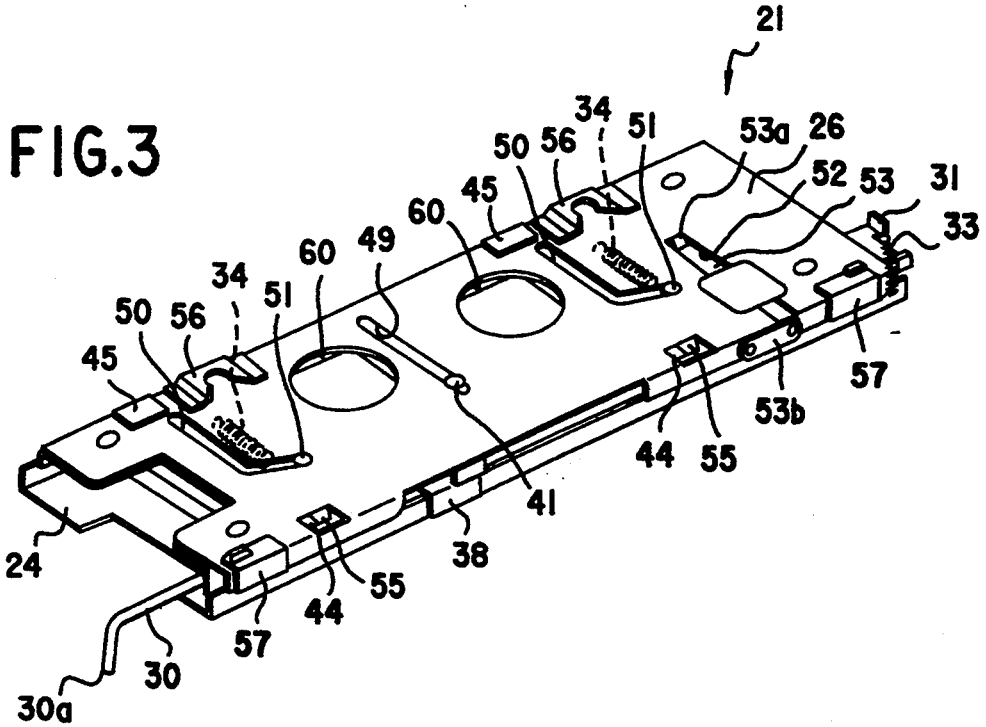
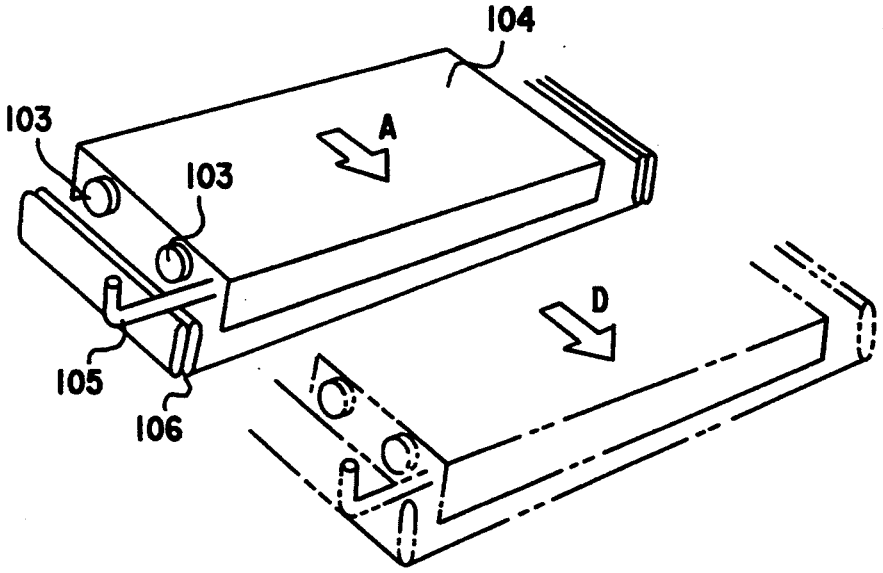
PRIOR ART
FIG.10

DEVELOPING UNIT SUPPORTING SYSTEM

TECHNICAL FIELD

The present invention relates to a developing unit supporting system for use in an image forming apparatus and, more particularly, to a developing unit supporting system for retracting, at the time of replacement or check of an expendable photosensitive drum, a developing unit so as to be kept away from the photosensitive drum.

BACKGROUND ART

In an image forming apparatus, a developing unit is generally disposed in the neighbourhood of a photosensitive drum for some functional reasons. Such an image forming apparatus is usually provided with a retracting mechanism for retracting the developing unit from its position close to the photosensitive drum in order to avoid damage caused by the contact of the developing unit with the photosensitive drum when replacement or check of the expendable photosensitive drum is carried out. When removing the developing unit from the image forming apparatus, it is also essential to provide a retracting mechanism in view of the above point.

A conventional retracting mechanism is shown in Figures 8 to 10. In the first example shown in FIG. 8, a fixed frame 102 is disposed adjacently to a photosensitive drum 101 and on the upper face of the fixed frame 102 is provided a developing unit supporting carrier 104 which can be moved in the direction (indicated by the arrow A) perpendicular to the axis of the photosensitive drum 101 by turning movement of wheels 103. The movement of the supporting carrier 104 is carried out in such a way: a shaft 105 disposed in the fixed frame 102 is pivoted about a specified angle in the direction indicated by the arrow B against the elastic force of a tension spring (not shown) and the inner wall of the supporting carrier 104 is accordingly pressed by cams (not shown) fixedly attached to the shaft 105.

Although the retracting mechanism shown in FIG. 8 has the advantage of having a simple construction since the developing unit supporting carrier 104 is designed to be movable only in the direction perpendicular to the axis of the photosensitive drum 101, the traveling distance of the supporting carrier 104 is considerably short because of the arrangement in which the supporting carrier 104 is pressed by the cams fixed to the shaft 105. This makes it difficult to ensure sufficient space necessary for mounting the developing unit onto the movable supporting carrier 104 or dismounting therefrom, and the mounting/dismounting operations have to be carried out with the developing unit being left in the image forming apparatus, and accordingly, the conventional apparatus has a problem in its operability.

One proposal for overcoming the above problem is such that as shown in FIGS. 9 and 10, there are provided slide rails 106 on the upper face of a fixed frame so as to move relative to the fixed frame in an axial direction of the photosensitive drum 101 (in the case of FIG. 9) or in a direction perpendicular to the axis of the photosensitive drum 101. According to the retracting systems shown in FIGS. 9 and 10, after the supporting carrier 104 has been retracted in the direction of the arrow A from the developing unit set position to a predetermined retraction position by pivoting the shaft 105 in the direction of the arrow B, the slide rails 106 are slid in the direction C perpendicular to the direction A (in the case of FIG. 9) or in the direction D that is the same as the direction A (in the case of FIG. 10), thereby moving the, supporting carrier 104 to a mounting/dismounting position.

With the arrangement in which the retraction position and the mounting/dismounting position are separately established and the mounting/dismounting position is established outside the apparatus, the foregoing problems relating to the space required for mounting-/dismounting of the developing unit and the efficiency of mounting/ dismounting operations can be solved. It will be noted that in the case shown in FIG. 9, the mounting/dismounting position for the developing unit is arranged in front of the apparatus in which the mechanism is incorporated whilst the mounting/dismounting position in the case of FIG. 10 is arranged on the side of the apparatus.

DISCLOSURE OF THE INVENTION

The prior art retracting mechanisms shown in FIGS. 9 and 10, however, have a problem in that the production cost is inevitably increased because the slide rails 106 are employed for moving the supporting carrier 104 from the retraction position to the mounting/dismounting position. Another problem encountered is that an extra space is required in the main body of the apparatus in order to accommodate maximum protruding parts of the developing unit when it is moved and this could be an obstacle to the promotion of the miniaturization of the apparatus.

The invention has been made in consideration of the foregoing drawbacks, and its prime object is, therefore, to provide a developing unit supporting system with which the miniaturization of the apparatus can be promoted by keeping space required for taking out of the developing unit to a minimum and with which the efficiency of the retracting operation for keeping the developing unit away from the photosensitive drum can be improved.

In order to accomplish the above object, a developing unit supporting system according to the invention, which supports a developing unit such that the developing unit can be retracted so as to be kept away from a photosensitive drum in a direction perpendicular to the axis of the photosensitive drum, comprises:

moving means for moving the developing unit in a direction substantially parallel with the axis of the photosensitive drum when the developing unit is at a middle position in the course of retraction.

In the developing unit supporting system having the first feature described above, when the developing unit is moved in a retracting direction perpendicular to the axis of the photosensitive drum, the moving direction of the developing unit is changed to a direction substantially parallel with the axis of the photosensitive drum when it reaches the middle position of retraction, whereby the contact of the developing unit with the main body of an apparatus in which the system is incorporated can be avoided when the developing unit is taken out of the apparatus and whereby space required in the main body of the apparatus for taking out of the developing unit can be kept to a minimum.

According to another aspect of the invention, there is provided a developing unit supporting system, which supports a developing unit such that the developing unit can be moved between a set position in the neighbourhood of a photosensitive drum and a mounting/dismounting position for the developing unit, comprising:

(a) a carrier body that is so supported on a fixed frame as to move in a direction perpendicular to the axis of the photosensitive drum and is usually held at the set position by energizing means;

(b) a slide table that can be moved in a direction perpendicular to the axis of the photosensitive drum to the mounting/dismounting position, after it has moved relative to the carrier body in a direction substantially parallel with the axis of the photosensitive drum to a predetermined middle position in such a manner that it is at least kept away from the photosensitive drum;

(c) first movement operation means disposed at the fixed frame, for operating the carrier body to move between the set position and a retraction position that is somewhat withdrawn from the set position in a direction perpendicular to the axis of the photosensitive drum; and (d) second movement operation means disposed at the carrier body, for operating the slide table to move relative to the carrier body in a direction substantially parallel with the axis of the photosensitive drum.

In the developing unit supporting system having the second future, the carrier body and the slide table, which support the developing unit, are usually held at the set position, where the developing unit is located adjacently to the photosensitive drum, by energizing means such as a tension spring. If the first movement operation means is operated in the above condition, the carrier body and the slide table will be retracted as one unit to the retraction position, being against a force exerted by the energizing means. If the second moment operation means is operated when the carrier body and the slide table are at the retraction position, the slide table is moved relative to the carrier body in a direction substantially parallel with the axis of the photosensitive drum to the middle position in such a manner the slide table is at least kept away from the photosensitive drum. By pulling the slide table forwardly at the middle position, the slide table can be moved relative to the carrier body in a direction perpendicular to the axis of the photosensitive drum to the mounting/dismounting position for the developing unit. The movement of the slide table in the two directions, that is, a direction perpendicular to the axis of the photosensitive drum and a direction substantially parallel with the axis of same prevents the contact of the developing unit with the main body of the apparatus when the developing unit is taken out of the apparatus, so that space required in the main body of the apparatus for taking out of the developing unit can be minimized.

In addition to the above components, the fixed frame is preferably provided with guide rails for guiding the carrier body when it moves.

It is preferable to provide first interlocking means for inhibiting the operation of the first movement operation means when the slide table is at the middle position or the mounting/dismounting position. In this case, the first interlocking means may be a stopper member that is disposed in tile first movement operation means and comes in contact with the slide table during pivoting operation of the first movement operation means, thereby preventing the pivoting of the first movement operation means.

It is also preferable to provide second interlocking means for inhibiting the operation of the second movement operation means when the carrier body is in the set position. The second interlocking means may be made such that a convex formed in the second movement operation means engages with a concave formed in the fixed frame when the carrier body is at the set position, thereby inhibiting the operation of the second movement operation means.

Suitably, there may be provided movement stopper means for stopping the movement of the carrier body, the movement being caused by external forces other than the force of the first movement operation means when the carrier body is at the set position. The movement stopper means may be a stopper member disposed in the carrier body and arranged so as to face to the first movement operation means with a little clearance between when the carrier body is at the set position.

There may be provided first movement preventing means for preventing the relative movement between the carrier body and the slide table when they are at the set position. In this case, the first movement preventing means could be a leaf spring disposed in the carrier body, for pressing the slide table against the carrier body, or alternatively it could be designed to prevent the relative movement between the carrier body and the slide table by engaging a projection formed in the carrier body with a groove formed in the slide table.

Further, there may be provided second movement preventing means for preventing the relative movement between the carrier body and the slide table when they are at the mounting/dismounting position. In this case, the second movement preventing means is preferably disposed in the slide table and designed such that the means moves down to a lower position while rocking because of its own weight so that it engages with an end face of the carrier body, thereby preventing the relative movement between the carrier body and the slide table.

With the above arrangement, when the slide table is at the middle position or the mounting/dismounting position, the operation of the first movement operation means is inhibited by the first interlocking means, and when the carrier body is at the set position, the operation of the second movement operation means is inhibited by the second interlocking means and the movement of the carrier body is prevented by the movement stopper means, the movement being caused by external forces other than the force of the first movement operation means. At the set position, the relative movement between the carrier body and the slide table is also prevented.

Preferably, the first movement operation means is composed of a shaft one end of which is bent in the form of L and a plurality of cams secured to the shaft at suitable intervals. By pivoting the shaft, the carrier body is pressed by the convex portions of the cams so that the carrier body can be moved.

The second movement operation means preferably comprises a lever which is pivotally supported on the carrier body such that the lever can freely pivot relative to the carrier body within a horizontal plane and which includes a projection at the upper face thereof. By pivoting the lever, the projection is brought in engagement with the groove formed in the slide table so that the slide table can be moved. In such a case, the carrier body is preferably provided with a groove which extends along the photosensitive drum, for preventing the contact of the projection with the carrier body when the projection moves. The slide table is preferably provided with a slide groove for guiding the projection when the slide table moves away from the photosensitive drum.

Preferably, the carrier body can move on the upper face of the fixed frame with the help of a plurality of wheels disposed at the underside of the carrier body. The energizing means is preferably a tension spring extended between the carrier body and the fixed frame.

The movement of the slide table relative to the carrier body is preferably carried out by moving an engaging pin disposed at the carrier body, being in engagement with a substantially L-shaped guide groove formed in the slide table. The L-shaped guide groove first extends in a direction perpendicular to the axis of the photosensitive drum and then turns in a direction substantially parallel with the axis of the photosensitive drum.

The developing unit supporting system to which the invention is applied is preferably incorporated in an image forming apparatus in which continuous paper sheets are used as a recording medium.

Other objects of the present invention will become apparent from the detailed description given hereinafter. However, it should be understood that the detailed description and specific examples, while indicating a preferred embodiment of the invention, are given by way of illustration only, since various changes and modifications within the spirit and scope of the invention will become apparent to those skilled in tile art from this detailed description.

BRIEF DESCRIPTION OF DRAWINGS

The present invention will become more fully understood from the detailed description given hereinbelow and accompanying drawings which are given by way of illustration only, and thus are not limitative of the present invention, and wherein:

FIGS. 1 to 10 are for explaining a preferred embodiment of a developing unit supporting system according to the invention;

FIG. 1 is a schematic view showing an essential part of the construction of an image forming apparatus in which a developing unit supporting carrier according to an embodiment of the invention is incorporated.

FIG. 2 is a perspective view showing the developing unit supporting carrier according to the embodiment of the invention, the supporting carrier being incorporated in the image forming apparatus;

FIG. 3 is a perspective view showing the developing unit supporting carrier according to the embodiment of the invention;

FIG. 4 is an exploded perspective view showing the developing unit supporting carrier according to the embodiment of the invention;

FIG. 6 is a partly diagrammatic perspective view showing a fixing structure of a slide table disposed in the developing unit supporting carrier according to the embodiment of the invention;

FIG. 7 is a partly diagrammatic perspective view of an interlocking mechanism of an operation arm disposed in the developing unit supporting carrier according to the embodiment of the invention;

FIG. 8 is a view of a first example of a conventional developing unit supporting carrier;

FIG. 9 is a view of a second example of a conventional developing unit supporting carrier; and FIG. 10 is a view of a third example of a conventional developing unit supporting carrier.

BEST MODE FOR CARRYING OUT THE INVENTION

Figure 1:
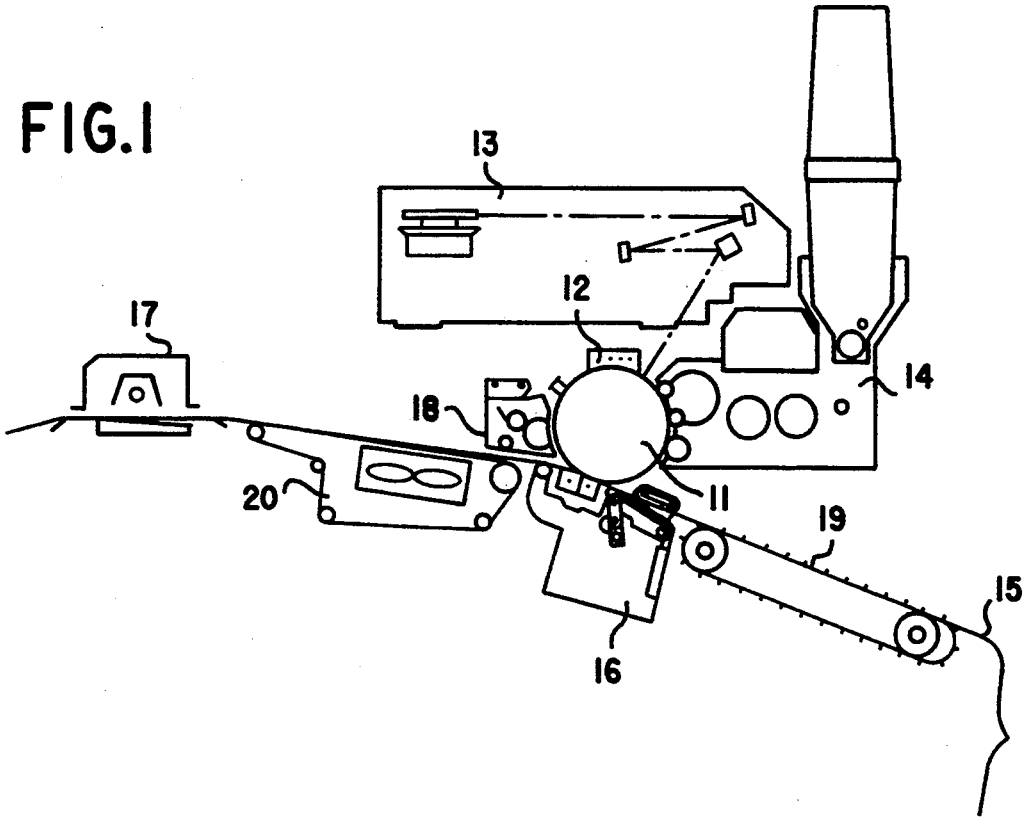

Referring now to the drawings, a preferred embodiment of a developing unit supporting system according to the invention will be hereinafter described.

FIG. 1 schematically illustrates an essential part of the construction of an image forming apparatus in which a developing unit supporting carrier according to an embodiment of the invention is incorporated. As shown in FIG. 1, the image forming apparatus of this embodiment comprises: a photosensitive drum 11; a front charger 12 for uniformly charging the surface of the photosensitive drum 11; an optical system 13 for irradiating areas on the surface of the photosensitive drum 11 charged by the front charger 12 in order to form an electrostatic latent image, the areas being other than an image forming area; a developing section 14 for forming a visible image by adhering toner to the electrostatic latent image formed by the optical system 13, the toner being charged to have an opposite polarity to that of the electrostatic latent image; a transferring guide section 16 for transferring a toner image formed by the developing section 14 onto a paper sheet (copy paper) 15 utilizing electrostatic force in such a way that a charge is applied to the reverse sidle of the paper sheet 15 overlaid on the toner image, the charge being of an opposite polarity to the charging polarity of the toner; a fixing section 17 for fusing the toner image, which has been transferred onto the paper sheet 15, using heat or pressure so as to be permanently fixed on the paper sheet 15; a cleaning section 18 for removing residual toner which has not been transferred but remained on the photosensitive drum 11; a tractor section 19 disposed at the upstream side of the photosensitive drum 11, for conveying the paper sheet 15; and a suction feeder section 20 disposed at the downstream side of the photosensitive drum 11, for conveying the paper sheet 15.

Figure 2:
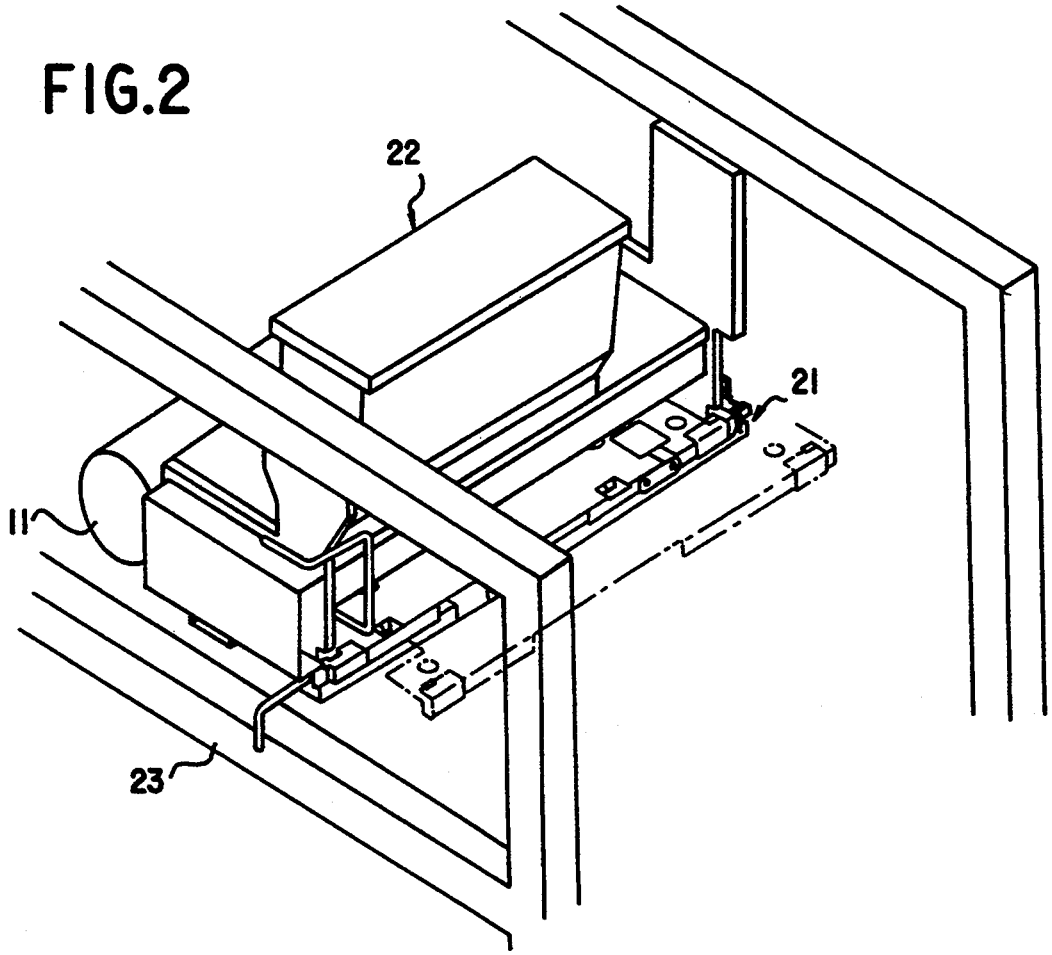
Figure 4:
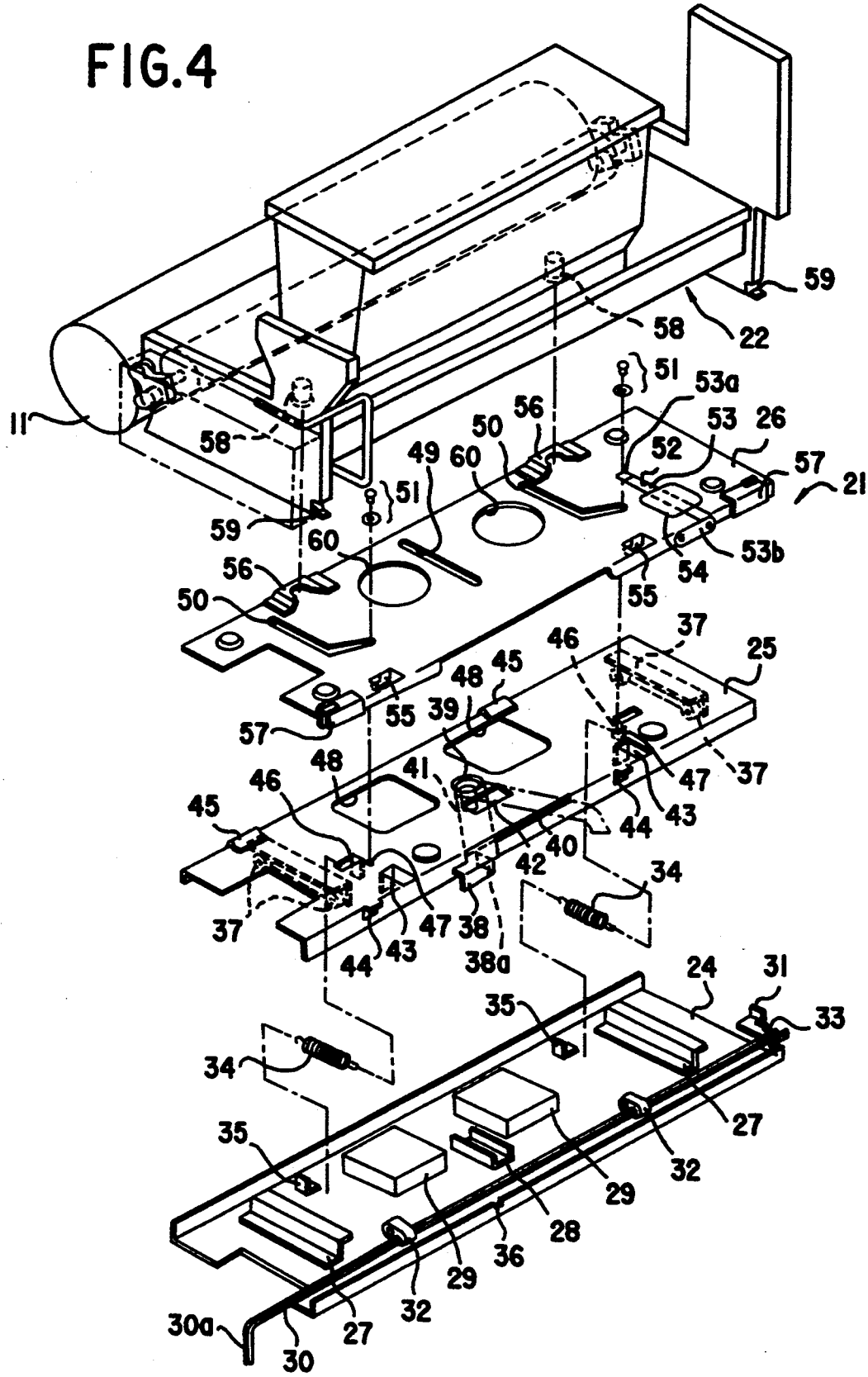
Figure 5A:
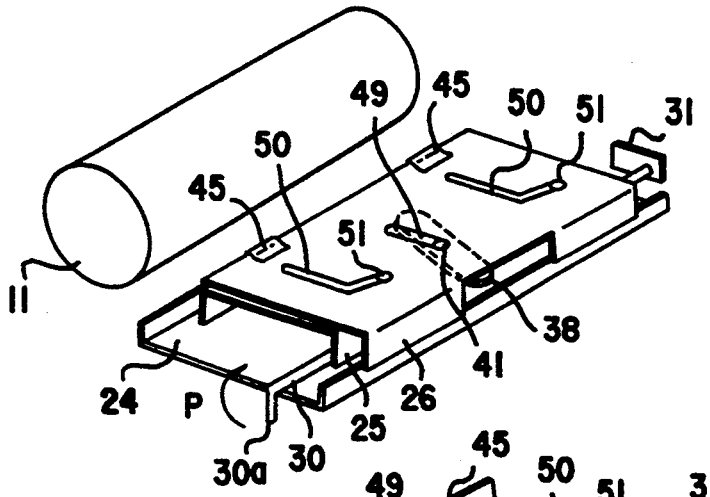
FIGS. 5(a)–(d) views showing the procedure for operating the developing unit supporting carrier according to the embodiment of the invention.
Figure 5B:
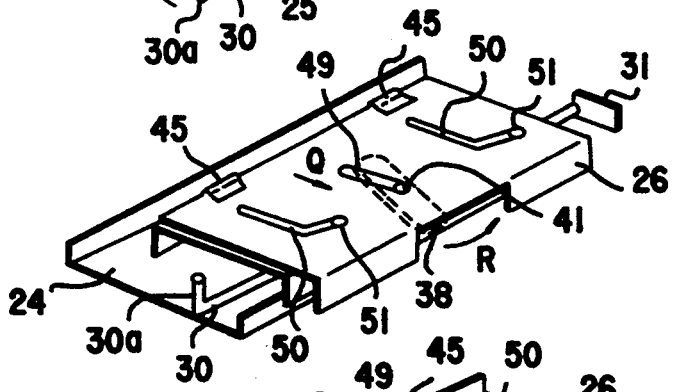
Figure 5C:
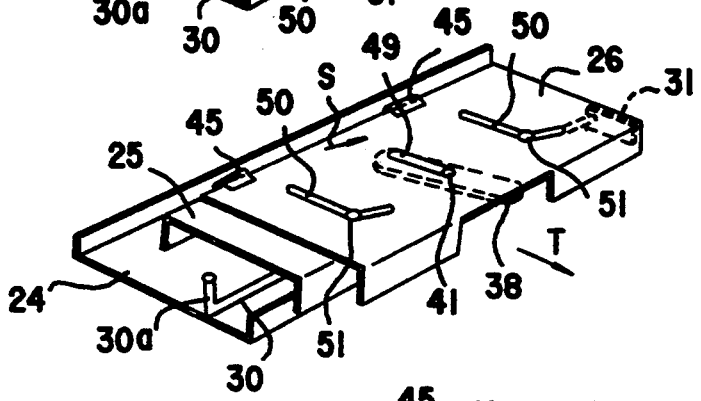
Figure 5D:
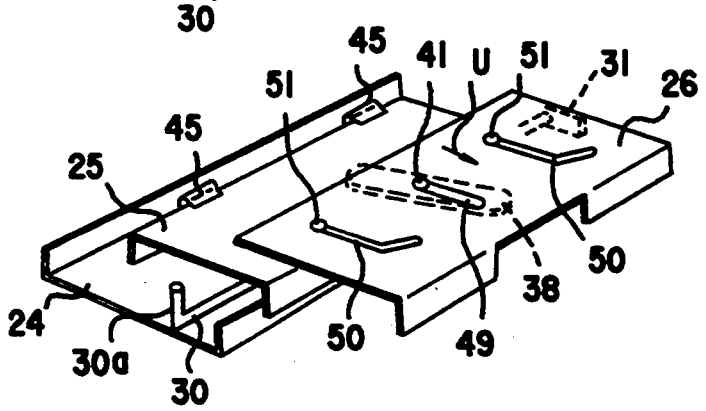

FIG. 2 shows a perspective view of the developing unit supporting carrier of the embodiment of the invention, the carrier being incorporated in the image forming apparatus, FIG. 3 shows a perspective view of the developing unit supporting system and FIG. 4 shows an exploded perspective view of the system corresponding to FIG. 2.

In this embodiment, a developing unit supporting carrier 21 constitutes a part of the developing section 14 and is laid along the axis of the: photosensitive drum 11, being adjacent to the photosensitive drum 11, such that a developing unit 22 can be mounted on the upper face of the developing unit supporting carrier 21. The developing unit supporting carrier 21 Is an assemblage made up of the following components: a plate-like stay 24 fixedly attached to a frame 23 of the main body of the image forming apparatus; a plate-like carrier body 25 disposed on the upper face of the stay 24 so as to move in a direction perpendicular to the axis of the photosensitive drum 11; and a plate-like slide table 26 disposed on the carrier body 25 so as to slide both in a direction substantially parallel with the axis of the photosensitive drum 11 and a direction perpendicular to the axis of the photosensitive drum 11.

The stay 24 is in the, form of a substantially rectangular plate and its two long sides (front end and rear end) are bent upwards. Disposed in the vicinity of both end edges of the upper face of the stay 24 are two guide rails 27 for guiding wheels 37 (to be described later) disposed in the carrier body 25. At the central part of the stay 24 is also disposed a guide rail 28 for guiding a roller (not shown) disposed at the underside of the carrier body 25. A fan 29 is disposed between the guide rail 28 and one of the guide rails 27 and another fan 29 is disposed between the guide rail 28 and the other guide rail 27 in order to cool the developing unit 22. At the front part (on the side opposite to the photosensitive drum 11) of the stay 24, a shaft 30 is pivotally supported, extending in a direction parallel with the axis of the photosensitive drum 11. One end (located on the front side of the apparatus) of the shaft 30 is bent at 90° so as to form a grip 30*a*, whilst the other end of the shaft 30 is provided with a stopper 31 for stopping the pivoting of the shaft 30 when the slide table 26 is in a specified position. The shaft 30 is also provided with cams 32 disposed at middle positions thereof, for regulating the movement of the carrier body 25. A tension coil spring 33 is extended between the stopper 31 and the stay 24. The stay 24 is provided with engaging pieces 35 for engaging with ends of tension coil springs 34 that are extended between the stay 24 and the carrier body 25, for pressing the carrier body 25 towards the photosensitive drum 11. Formed at the specified position of the front edge of the stay 24 is a cut-away portion 36 for engaging with a bent piece 38*a* of an operation arm 38 (to be described later) when the carrier body 25 is in a developing unit set position in the neighbourhood of the photosensitive drum 11.

The carrier body 25 is in the form of a substantially rectangular plate of which two long sides (front end and rear end) are bent downwards. The bottom face of the carrier body 25 is provided with two pairs of wheels 37 disposed relative to the guide rails 27 of the stay 24. By means of these four wheels 37, the carrier body 25 can be moved along the guide rails 27. The operation arm 38 is pivotally supported at a fulcrum 39 in a substantially central position of the bottom face of the carrier body 25. The operation arm 38 projects forwardly from the carrier body 25, passing through an elongated slit 40 formed at a substantially central position of the front face of the carrier body 25. The front end of the operation arm 38 is bent in the form of "L" so as to match to the shape of the front edge of the stay 24. The operation arm 38 has a bent piece 38*a* disposed in the neighbourhood of the front end thereof, for engaging with the cut-away portion 36 of the stay 24. The slit 40 is a little wider at both ends than its centre, whereby the operation arm 38 can be positively positioned at its stop position. Fixedly attached to the upper face of the operation arm 38 is a pin 41 which engages with a slide groove 49 (to be described later) formed at the slide table 26, and the carrier body 25 is provided with a rectangular hole 42 defined in an area which corresponds to the movable range of the pin 41. Stoppers 43 are formed on the right and left hands in the front part of the carrier body 25, being bent downwardly. These stoppers 43 face to the cams 32 respectively being a little distance apart from the tip portions of the cams 32 when the carrier body 25 is set on the stay 24. With this arrangement, when an external force is applied to the developing unit 22 at the developing unit set position, being against the elastic force of the tension coil springs 34 so that tile developing unit 22 is pressed in a direction opposite to the photosensitive drum 11, the tip portions of the cams 32 come in contact with the stoppers 43, thereby keeping the movements of the cams 32 to a minimum.

The carrier body 25 is provided with two bent projections 44 formed at the front end thereof and two leaf springs 45 attached at the rear end thereof to prevent the positional jitter of the slide table 26 in relation to the carrier body 25 at the developing unit set position. Specifically, the projections 44 respectively fit in bent pieces 55 (to be described later) formed in the slide table 26, thereby preventing the positional jitter of the front end of the slide table 26, whilst the leaf springs 45 press the rear end of the upper face of the slide table 26 down, thereby preventing the positional jitter of the rear end of the slide table 26. The carrier body 25 is provided with engaging pieces 46 for engaging with the other ends of the tension coil springs 34 to secure them. The carrier body 25 is further provided with holes 47 defined in the neighbourhood of the engaging pieces 46 to fix pins 51 (to be described later ). Reference numerals 48 represent holes through which air sent from the fans 29 pass.

The slide table 26 is bent downwardly at the front end thereof except for the area corresponding to the movable range of the substantially rectangular plate-like operation arm 38. At the central portion of the slide table 26, the slide groove 49 for guiding the pin 41 extends in a direction perpendicular to the axis of the photosensitive drum 11. 0n both sides of the slide groove 49, guide grooves 50 extend from the neighbourhood of the rear end of the slide table 26 in a direction perpendicular to the axis of the photosensitive drum 11, being bent at an obtuse angle towards the rear part of the apparatus (to the right hand when viewing the photosensitive drum 11). Pins 51 are respectively inserted into the guide grooves 50 from above to regulate the movement of the slide table 26 relative to the carrier body 25 so that the slide table 26 moves in a direction along the guide grooves 50. The pins 51 are also inserted into the holes 47 defined in the carrier body 25, with the lower ends being fixed to the carrier body 25. The slide table 26 is also provided with a slit 52 formed at the right hand when viewing the photosensitive drum 11, extending from the front edge of the slide table 26 in a direction perpendicular to the axis of the photosensitive drum 11. Within the slit 52 is provided a stopper bar 53 for preventing the slide table 26 from unintentionally moving towards the photosensitive drum 11 when it is at the mounting/dismounting position for the developing unit 22. The stopper bar 53 includes an upwardly extending bent part 53*a* at its end located on the side of the photosensitive drum 11 and a press operation part 53*b* at the other end thereof located at the opposite side of the photosensitive drum 11, the press operation part 53 being formed along the front end face of the slide table 26. The stopper bar 53 swings upwardly and downwardly about the fulcrum located in the neighbourhood of the front end of the slide table 26. The stopper bar 53 is held such that when the developing unit 22 is at its mounting/dismounting position, the bent part 53*a* comes to its lower position because of its own weight, so that the end edge of the bent part 53*a* comes in contact with the front end face of the carrier body 25, thereby preventing the unintentional movement of the slide table 26, and such that when the slide table 26 is slid from the mounting/dismounting position in relation to the carrier body 25, the press operation part 53*b* is pressed thereby allowing the stopper bar 53 to pivot upwardly in order to release the end edge of the bent part 53*a* from the contact with the front end face of the carrier body 25. Note that the stopper bar 53 is prevented from upwardly pivoting more than a predetermined angle by means of an interrupter board 54 which intersects the slit 52.

The slide table 26 is also provided with the bent pieces 55 formed relative to the projections 44 of the carrier body 25. The projections 44 fit into the bent pieces 55 respectively, thereby preventing the positional jitter of the front end of the slide table 26. In order to fix the developing unit 22 on the slide table 26, first clamps 56 are provided at the rear end of the slide table 26 and second clamps 57 at the front end of same. The first clamps 56 support cylindrical support pins 58 projecting from the bottom face of the developing unit 22, thereby preventing the movement of the developing unit 22 towards the photosensitive drum 11. On the other hand, the second clamps 57 are inserted in cut-away portions 59 formed at the front lower end of the developing unit 22, thereby pressing the developing unit 22 towards the first clamps 56 and preventing the upward movement of the front; part of the developing unit 22. Fixing of the developing unit 22 on the slide table 26 by the use of the first and second clamps 56, 57 is carried out with the following procedure: the developing unit 22 is first mounted on the slide table 26, with the second clamps 57 being loosened, such that the support pins 58 come in contact with the first clamps 56. The developing unit 22 is then pressed backwardly, and the second clamps 57 are inserted in the cut-away portions 59 and clamped. Reference numerals 60 represent holes through which air sent from the fans 29 pass.

With reference to FIG. 5, the operation procedure and movement of the developing unit supporting carrier 21 having the above-described construction will be described below.

Figure 6:
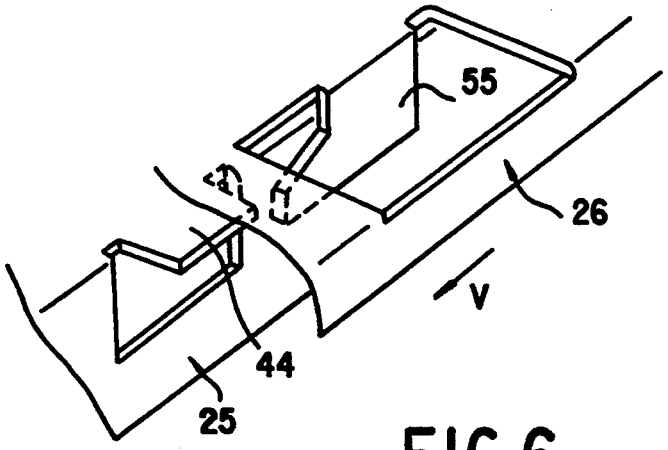
Figure 7:
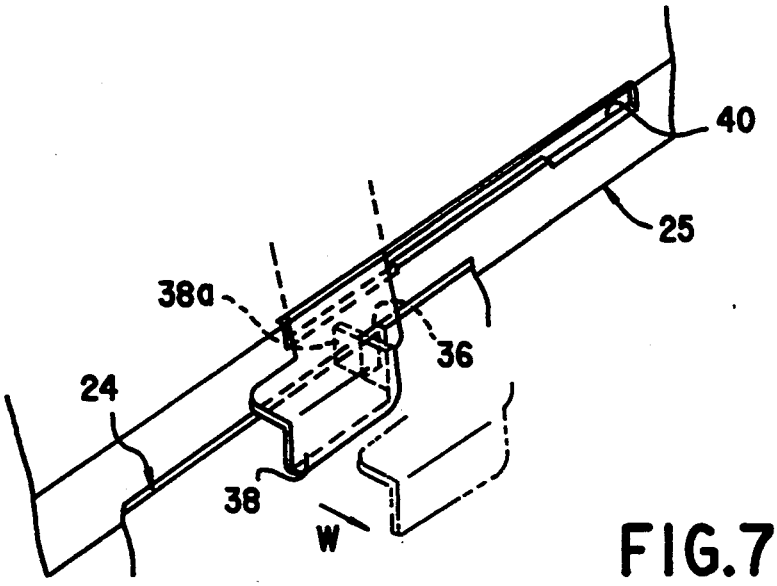
Figure 8:
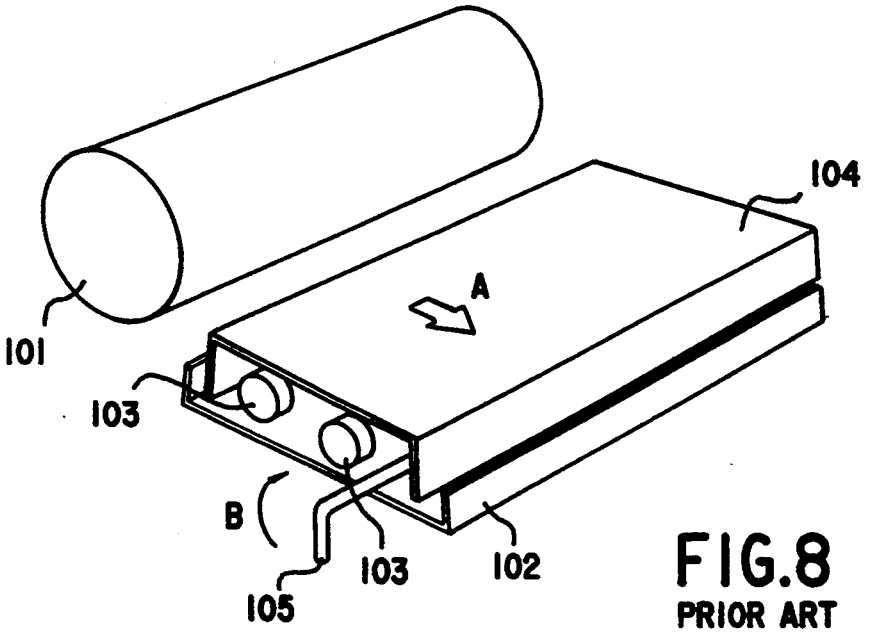
FIG.8 PRIOR ART
Figure 9:
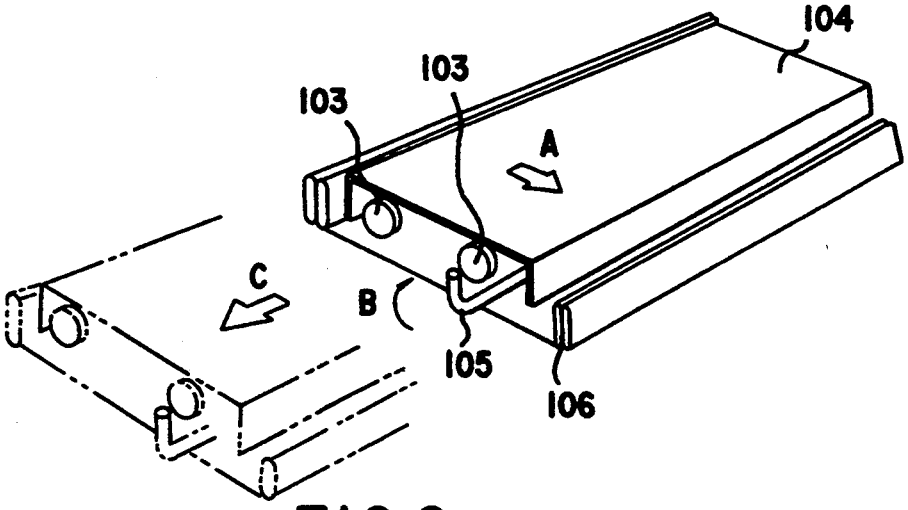
FIG.9 PRIOR ART

In the developing unit set position shown in FIG. 5(*a*) where the developing unit 22 is positioned in the neighbourhood of the photosensitive drum 11, the carrier body 25 is pressed against the stay 24 in a direction towards the photosensitive drum 11 by means of the elastic force of the tension coil springs 34. In this condition, the projections 44 of the carrier body 25 fit in the bent pieces 55 of the slide table 26 as indicated by the arrow V in FIG. 6, and the leaf springs 45 press the rear upper end face of the slide table 26 down, thereby preventing the positional jitter of the slide table 26. In the developing unit set position, the operation arm 38 cannot be operated since the bent piece 38*a* of the operation arm 38 fits in the cut-away portion 36 of the stay 24 as shown in FIG. 7. Further, in this set position, even if an external force is exerted on the developing unit 22 against the elastic force of the tension coil springs 34 so that the developing unit 22 is pressed in a direction opposite to the photosensitive drum 11, the movement of the developing unit 22 can be kept to a minimum since the tip portions of the cams 32 are brought in contact with the stoppers 43.

For moving the developing unit 22 from such a set position to the mounting/dismounting position, the grip 30*a* is firstly held and operated so that the shaft 30 pivots about 180° in the direction P in FIG. 5(*a*). By doing so, the inner wall of the front end face of the carrier body 25 is pressed by the cams 32 fixed to the axis 30 and the carrier body 25 moves along the guide rails 27 in the direction of the arrow Q until the retraction position shown in FIG. 5(*b*), being integral with the slide table 26. Since the direction of a force exerted on the tension coil spring 33 at the time of pivoting of the shaft 30 is reversed during the pivoting movement of the shaft 30, the shaft 30 is stably kept at a position which the shaft 30 has reached after pivoting about 180°.

After the carrier body 25 has accordingly moved, this movement causes the operation arm 38 to move in the direction of the arrow W in FIG. 7, whereby the bent piece 38*a* of the operation arm 38 is disengaged from the cut-away portion 36 of the stay 24. When the operation arm 38 is then operated to pivot in the direction. R in FIG. 5(*b*), the edge of the slide groove 49 is pressed by the pin 41 fixed to the operation arm 38 and the pins 51 are guided by the guide grooves 50 so that the slide table 26 moves relative to the carrier body 25 in the direction of the arrow S as shown in FIG. 5(*c*) and reaches tile middle position which is the stroke end of the direction S. Thereafter, the slide table 26 is pulled out in the direction of the arrow T from the middle position, whereby the pins 51 are guided by the guide grooves 50 and the pin 41 is guided by the slide groove 49 so that the slide table 26 moves relative to the carrier body 25 in the direction of the arrow U as shown in FIG. 5(*d*) until it reaches the mounting/dismounting position which is the stroke end of the direction U.

For mounting the developing unit 22, the above-described procedure is taken in a reverse order. At the time the developing unit 22 is mounted, the bent part 53*a* formed at the tip portion of the stopper bar 53 comes down to its lower position and is held thereat because of its own weight, bringing the end edge of the bent part 53*a* into contact with the front end face of the carrier body 25 so that the unintentional movement of the slide table 26 can be prevented. In order to slide the slide table 26 in relation to the carrier body 25 in the above condition, the press operation part 53*b* is pressed, thereby pivoting the stopper bar 53 upwards. At the middle position or the mounting/dismounting position, the stopper 31 formed at the tip portion of the shaft; 30 is positioned under the slide table 26 as shown in FIGS. 5(*c*) and 5(*d*), and therefore, even if the shaft 30 is operated by the grip 30*a* so as to pivot, the pivoting is prevented since the stopper 31 is in contact with the bottom face of the slide table 26.

According to the developing unit supporting carrier 21 of the foregoing embodiment, when pulling the developing unit 22 from the set position (indicated by the solid line in FIG. 2) in the neighbourhood of the photosensitive drum 11 to the mounting/dismounting position (indicated by the two-dot chain line in FIG. 2) at the time of check or replacement of the photosensitive drum 11, the contact of the developing unit 22 with the frame 23 of the main body can be avoided by moving the developing unit 22 in a direction perpendicular to the axis of tile photosensitive drum 11 and in a direction substantially parallel with the axis of the photosensitive drum 11, and accordingly space required for taking out of the developing unit 22 can be minimized.

Although the guide grooves 50 in the above embodiment are designed to be bent at an obtuse angle, the shape of the guide grooves 50 is not necessarily limited to this; for example, the guide grooves 50 could be bent at right angles.

It should be noted that the developing unit 22 in the above embodiment corresponds to the developing unit (1) of the invention; the photosensitive drum 11 to the photosensitive drum (2); the stay 24 to the fixed frame (3); the tension coil spring 34 to the energizing means (4); the carrier body 25 to the carrier body (5); the slide table 26 to the slide table (6); the shaft 30 to the first movement operation means (7); and the operation arm 38 to the second movement operation means (8).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developing unit supporting system for supporting a developing unit such that the developing unit can be retracted so as to be kept away from a photosensitive drum in a direction perpendicular to the axis of the photosensitive drum, comprising:

moving means for moving the developing unit in a direction substantially perpendicular to an axis of the photosensitive drum, to move the developing unit into a first position in a course of retraction, and in a direction substantially parallel with the axis of the photosensitive drum to move the developing unit into a second, middle position in the course of retraction, wherein said moving means moves the developing unit in a direction substantially perpendicular to an axis of the photosensitive drum to move the developing unit into a third position in the course of retraction.

2. A developing unit supporting system which supports a developing unit such that the developing unit can be moved between a set position in the neighbourhood of a photosensitive drum and a mounting/dismounting position for the developing unit, comprising:

(a) a carrier body that is so supported on a fixed frame as to move in a direction perpendicular to the axis of the photosensitive drum and is usually held at the set position by energizing means;

(b) a slide table that can be moved in a direction perpendicular to the axis of the photosensitive drum to the mounting/dismounting position, after it has moved relative to the carrier body in a direction substantially parallel with the axis of the photosensitive drum to a predetermined middle position in such a manner that it is at least kept away from the photosensitive drum;

(c) first movement operation means disposed at the fixed frame, for operating the carrier body to move between the set position and a retraction position that is somewhat withdrawn from the set position in a direction perpendicular to the axis of the photosensitive drum; and (d) second movement operation means disposed at the carrier body, for operating the slide table to move relative to the carrier body in a direction substantially parallel with the axis of the photosensitive drum.

3. The developing unit supporting system as claimed in claim 2, wherein the fixed frame is provided with guide rails for guiding the carrier body when it moves.

4. The developing unit supporting system as claimed in claim 2 or 3, further comprising first interlocking means for inhibiting the operation of the first movement operation means when the slide table is at the middle position or at the mounting/dismounting position.

5. The developing unit supporting system as claimed in claim 4, wherein the first interlocking means is a stopper member that is disposed in the first movement operation means and comes in contact with the slide table during pivoting operation of the first movement operation means, thereby preventing the pivoting of the first movement operation means.

6. The developing unit supporting system as claimed in any one of claims 2 or 3, further comprising second interlocking means for inhibiting the operation of the second movement operation means when the carrier body is at the set position.

7. The developing unit supporting system as claimed in claim 6, wherein the second interlocking means inhibits the operation of the second movement operation means by engaging a convex formed in the second movement operation means with a concave formed in the fixed frame when the carrier body is at the set position.

8. The developing unit supporting system as claimed in any one of claims 2 or 3, further comprising movement stopper means for stopping the movement of the carrier body caused by other external forces than a force exerted by the first movement operation means when the carrier body is at the set position.

9. The developing unit supporting system as claimed in claim 8, wherein the movement stopper means is a stopper member disposed in the carrier body and arranged so as to face to the first movement operation means with a little clearance between, when the carrier body is at the set position.

10. The developing unit supporting system as claimed in any one of claims 2 or 3, further comprising first movement preventing means for preventing the relative movement between the carrier body and the slide table at the set position.

11. The developing unit supporting system as claimed in claim 10, wherein the first movement preventing means is a leaf spring disposed in the carrier body, for pressing the slide table against the carrier body.

12. The developing unit supporting system as claimed in claim 10, wherein the first movement preventing means prevents the relative movement between the carrier body and the slide table by engaging a projection formed in the carrier body with a groove formed in the slide table.

13. The developing unit supporting system as claimed in any one of claims 2 or 3, further comprising second movement preventing means for preventing the relative movement between the carrier body and the slide table at the mounting/dismounting position.

14. The developing unit supporting system as claimed in claim 13, wherein the second movement preventing means is disposed in the slide table and designed such that it rocks and moves down to a lower position because of its own weight so as to engage with an end face of the carrier body, thereby preventing the relative movement between the carrier body and the slide table.

15. The developing unit supporting system as claimed in any one of claims 2 or 3, wherein the first movement operation means is composed of a shaft one end of which is bent in the form of L and a plurality of cams secured to the shaft at suitable intervals, and the shaft is operated so as to pivot, thereby pressing the carrier body with convex portions of the cams in order to move the carrier body.

16. The developing unit supporting system as claimed in any one of claims 2 or 3, wherein the second movement operation means comprises a lever which is pivotally supported on the carrier body such that the lever can freely pivot relative to the carrier body within a horizontal plane and which includes a projection at the upper face thereof, and the lever is operated to pivot, thereby engaging the projection with the groove formed in the slide table in order to move the slide table.

17. The developing unit supporting system as claimed in claim 16, wherein the carrier body includes a groove disposed extending along the photosensitive drum, for preventing the contact of the projection with the carrier body when the projection moves.

18. The developing unit supporting system as claimed in claim 16, wherein the slide table includes a slide groove for guiding the projection when the slide table moves away from the photosensitive drum.

19. The developing unit supporting system as claimed in any one of claims 2 or 3, wherein the carrier body can move on the upper face of the fixed frame with the help of a plurality of wheels disposed at the underside of the carrier body.

20. The developing unit supporting system as claimed in any one of claims 2 or 3, wherein the energizing means is a tension spring extended between the carrier body and the fixed frame.

21. The developing unit supporting system as claimed in any one of claims 2 or 3, wherein the movement of the slide table relative to the carrier body is carried out by moving an engaging pin disposed at the carrier body, being engaged with a substantially L-shaped guide groove formed in the slide table, the L-shaped guide groove first extending in a direction perpendicular to the axis of the photosensitive drum and then turning in a direction substantially parallel with the axis of the photosensitive drum.

22. The developing unit supporting system as claimed in any one of claims 1, 2, or 3 which is incorporated in an image forming apparatus in which continuous paper sheets are used as a recording medium.

* * * * *